United States Patent [19]

Seifert

[11] 4,410,141

[45] Oct. 18, 1983

[54] FUEL INJECTION NOZZLE FOR INTERNAL COMBUSTION ENGINES

[75] Inventor: Kurt Seifert, Esslingen-Zollberg, Fed. Rep. of Germany

[73] Assignee: Robert Bosch GmbH, Stuttgart, Fed. Rep. of Germany

[21] Appl. No.: 209,347

[22] Filed: Nov. 21, 1980

[30] Foreign Application Priority Data

Dec. 5, 1979 [DE] Fed. Rep. of Germany ..... 2948907

[51] Int. Cl.[3] ..... F02M 61/08

[52] U.S. Cl. ..... 239/453; 239/533.9

[58] Field of Search ..... 239/533.9, 533.8, 533.7, 239/533.6, 533.5, 533.3, 533.4, 533.2, 533.10, 533.11, 533.12, 562, 563, 88, 89, 90, 91, 92, 453

[56] References Cited

U.S. PATENT DOCUMENTS 4,284,049 8/1981 Chmela ..... 239/533.9

4,285,471 8/1981 Eblen et al. ..... 239/533.9

*Primary Examiner*—James B. Marbert

*Attorney, Agent, or Firm*—Edwin E. Greigg

[57] ABSTRACT

A fuel injection nozzle is proposed which opens toward the outside and functions with a valve needle and two springs, and further wherein a throttle restriction is effective after a first portion of the opening stroke, acting as a pre-stroke, and can be subsequently rendered ineffective. The two springs having a predetermined certain relationship to one another enable an abrupt increase in closing force after the pre-stroke. The first spring, embodied as a compression spring, acts in the closing direction; the second spring, having a smaller force than the first spring and acting counter to the closing direction, is rendered ineffective after the pre-stroke has been performed.

3 Claims, 1 Drawing Figure

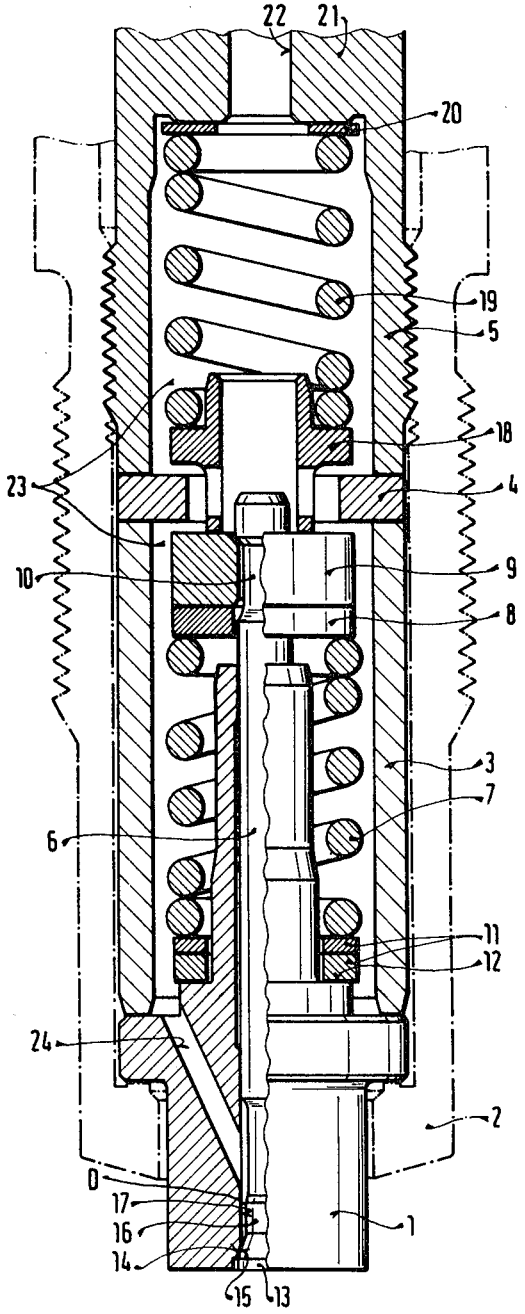
22
21
20
19
5
18
4
23
10
9
8
3
7
6
11
12
24
2
D
17
16
14
1
15
13

FUEL INJECTION NOZZLE FOR INTERNAL COMBUSTION ENGINES

BACKGROUND OF THE INVENTION

The invention is based on a fuel injection nozzle for internal combustion engines. At small injection quantities, a prolongation of the injection time is attained as a result of the throttle restriction in the fuel flow, and thus quieter engine running is attained. Furthermore, the fuel is better prepared in the case of the smaller quantities which are injected during idling and partial load, which brings about both a decrease in the specific fuel consumption and a substantial reduction in toxic exhaust gas components. At larger injection quantities, such as in the upper partial-load range and at full load, the throttle restriction is then made ineffective, so that because of the larger flowthrough cross section there are no throttling losses and there is sufficient fuel preparation. Demands such as this are being made by engine manufacturers and the developers of such injection systems as this, and various solutions are known for meeting these demands. However, these known fuel injection nozzles have the disadvantage that renders the throttle restriction ineffective during the opening stroke is dependent more or less exclusively on the quantity of fuel supplied. Even small differences in the force of the closing spring, for instance caused by partial failure after a period of use, cause a shift in the instant at which the throttle restriction is rendered ineffective, this instant being dependent on the fuel quantity. This results in substantial disadvantages in terms of fuel preparation and consumption as well as of quiet engine operation.

Subjecting the valve needle to the force of at least two springs in a certain relationship to one another has already been proposed to attain this end. These springs effect an abrupt increase in closing force after the pre-stroke because after the pre-stroke the force of the second spring is added to that of the first. However, this proposed solution, which does avoid the disadvantages discussed above, requires the complete restructuring of the injection nozzle in comparison with a nozzle functioning with only one spring; accordingly, in the course of production these elements, which require particular precision of manufacture, must undergo separate production processes.

OBJECT AND SUMMARY OF THE INVENTION

The fuel injection nozzle according to the invention has the advantage over the prior art that a mass-produced structural element of the nozzle, which has a spring and opens toward the outside, can be used for the purpose of creating a pressure stage and is equipped with a single additional element effecting the pressure stage. As a result not only is a significant cost saving attained in the manufacture of these precise structural elements; in addition, there is a simplification of the structure which enables the attainment of better reliability, especially because of the improved injection quality.

The invention will be better understood and further objects and advantages thereof will become more apparent from the ensuing detailed description of a preferred embodiment taken in conjunction with the drawing.

BRIEF DESCRIPTION OF THE DRAWING

One exemplary embodiment of the invention is shown in the single FIGURE of the drawing and described in detail below.

DESCRIPTION OF THE PREFERRED EMBODIMENT

The fuel injection nozzle shown in the drawing is seen partially in cross section and partially in phantom elevation, so as to provide a better understanding of its proportions. A shaft-like nozzle body 1 is held tightly against a nozzle holder 5 by a sleeve nut 2, with an interposed sheath 3 and a stop ring 4, said sheath 3 and ring 4 may also be embodied as a one-piece cap-like element. The sleeve nut 2 is indicated by dot-dash lines, and the nozzle holder 5 is only partially shown.

A valve assembly is secured directly on the nozzle body 1 and comprises a valve needle 6, a closing spring 7, a spring plate 8 and a holder ring 9. The holder ring 9 is suspended, via a keyhole not shown in detail, inside an annular groove 10 of the valve needle 6. The closing spring 7 is supported on one end via shims 11—11 on a shoulder 12 of the nozzle body 1 and on the other end on the spring plate 8. The head 13 of the valve needle 6 is held with a conical face 14 pressed by the spring 7 against a conical valve seat 15 disposed on the nozzle body 1. A cylindrical portion 16 adjoins the cone 14 and together with the inner bore 17 of the nozzle body 1, which receives the valve needle 6, defines a throttle restriction D. As soon as the fuel injection nozzle is fully opened, this shoulder 16 emerges from the bore 17, so that the throttle cross section no longer exists per se.

A spring plate 18 of a second compression spring 19 engages the holder ring 9 on the side remote from the injection side. This second compression spring 19 is supported, on its side remote from the spring plate 18, on an area of the nozzle holder indicated at 21 via a shim 20. Now, as soon as fuel under pressure reaches the interior 23 of the fuel injection nozzle via a pressure channel 22, the fuel flows via a pressure bore 24 in the nozzle body 1 toward the injection port. When there is sufficiently high pressure in the interior 23, the valve needle is displaced, this action being reinforced by the spring 19 but taking place counter to the force of the closing spring 7, until the spring plate 18 of the spring 19 strikes the stop ring 4. During this pre-stroke, the shoulder 16 does not yet emerge from the inner bore 17, so that the throttle restriction D is fully effective during the injection. After the pressure increase has compensated for the now-inactive spring 19, the valve needle 6 is displaced further counter to the spring 7, after which the shoulder 16 emerges from the bore 17 and this throttling effect is precluded.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A fuel injection nozzle for internal combustion engines comprising a nozzle body, a bore in one end of said nozzle body, a valve needle disposed in said valve body that opens in the direction of fuel flow, a first spring positioned relative to said valve needle to produce a closing force on said valve needle, said valve needle having a control location for fuel passage disposed adjacent to the end of said nozzle body including said bore which also serves to guide said valve needle in said nozzle body, said nozzle body further having a throttle restriction in the fuel flow which is controlled by said valve needle in accordance with a stroke of said valve needle, said throttle restriction being effective during a first portion of an opening stroke thereby acting as a pre-stroke and is subsequently rendered ineffective, a stop ring held tightly against said nozzle holder by a sheath-like sleeve nut which encompasses said nozzle body and said first spring, a second spring positioned relative to said valve needle and supported on one end on said nozzle holder and on its other end on a spring support plate wherein said valve needle is subjected to the force of at least two springs, said spring support plate including an axial extension that extends through said stop ring and which extension is supported on a valve needle holder ring and an annular portion which abuts said stop ring after a pre-stroke movement of said valve needle, said first and second springs having a predetermined relationship with one another which effect an abrupt increase in closing force after the pre-stroke, of which said first spring, embodied as a compression spring, always acts in the closing direction, characterized in that said second spring has a smaller force than said first spring and said second spring further acts counter to said first spring only until after a set distance of movement for the pre-stroke has been covered and the effect of the force of said second spring upon the valve needle is precluded by abutment of said spring support plate on said stop ring.

2. A fuel injection nozzle as defined by claim 1, characterized in that between said nozzle body and said ring-like stop there is arranged a sheath encompassing said first spring and being held tightly against said stop and said nozzle holder by said sleeve nut.

3. A fuel injection nozzle as defined by claim 2, characterized in that said ring-like stop and said sheath are embodied as a one-piece cap-like element.

* * * * *